United States Patent [19]

Schmitt et al.

[11] 4,030,165

[45] June 21, 1977

[54] DEVICE FOR DRAFTING LONG STAPLE FIBRE SLIVER

[75] Inventors: Ludwig Schmitt, Manching; Joachim Kipping, Ingolstadt, both of Germany

[73] Assignee: Schubert & Salzer Maschinenfabrik Aktiengesellschaft, Ingolstadt, Germany

[22] Filed: May 17, 1974

[21] Appl. No.: 471,016

Related U.S. Application Data

[63] Continuation of Ser. No. 353,713, April 23, 1973, abandoned, which is a continuation of Ser. No. 139,629, May 3, 1971, abandoned.

[30] Foreign Application Priority Data

May 8, 1970 Germany ..... 2022482

[52] U.S. Cl. ..... 19/.2; 19/128; 19/258

[51] Int. Cl.[2] ..... D01G 31/00; D01H 5/24

[58] Field of Search ..... 19/.2, 65 A, 128, 258, 19/236, 127, 129 R; 74/219

[56] References Cited

UNITED STATES PATENTS

| | | | |
|---|---|---|---|
| 1,937,570 | 12/1933 | Holdsworth | 19/129 R |
| 2,728,954 | 1/1956 | Holdsworth | 19/236 |
| 2,734,231 | 2/1956 | Boer | 19/128 |
| 2,754,548 | 7/1956 | Heitmuller et al. | 19/127 |
| 2,761,179 | 9/1956 | Lepoutre | 19/128 X |
| 3,344,479 | 10/1967 | Bryan, Jr. | 19/236 X |
| 3,572,147 | 3/1971 | Obenshain | 74/219 |
| 3,611,507 | 10/1971 | Ootsuki et al. | 19/258 X |

*Primary Examiner*—Dorsey Newton
*Attorney, Agent, or Firm*—Bailey, Dority & Flint

[57] ABSTRACT

A series of roller pairs in the drafting zone of sliver drafting apparatus have toothed or needlelike projections. The projections are spaced circumferentially and axially of the rollers so that projections of cooperating rollers either within a pair or between rollers of adjacent pairs are periodically interdigitated, as seen axially of the rollers, in spaced relationship as the rollers rotate at constant angular velocity. The rollers carry toothed wheels engageable for positive drive without backlash by a toothed belt. The upper rollers of the pairs are driven by a common endless loop belt and the lower rollers by a second belt. Each belt passes over a spring-loaded jockey roller which tensions the belt and which can be moved against the spring force in response to overloading tension on the belt caused by retardation of roller rotation in response to excessive fibres between a roller pair. Such movement of the jockey roller actuates a limit switch to shut off the belt drive motor. Spacing of the interdigitated projections permits the sliver to move linearly continuously through the drafting zone while restraining local portions of the sliver so that adjacent fibres slide relative to the projections and to adjacent fibres and progress through the spaces defined between the cooperating projections. The projections have convexly curved trailing edges to facilitate smooth withdrawal from sliver penetration.

3 Claims, 4 Drawing Figures

INVENTORS,
LUDWIG SCHMITT
JOACHIM KIPPING
BY Robert W. Beach
ATTORNEY

Fig. 2
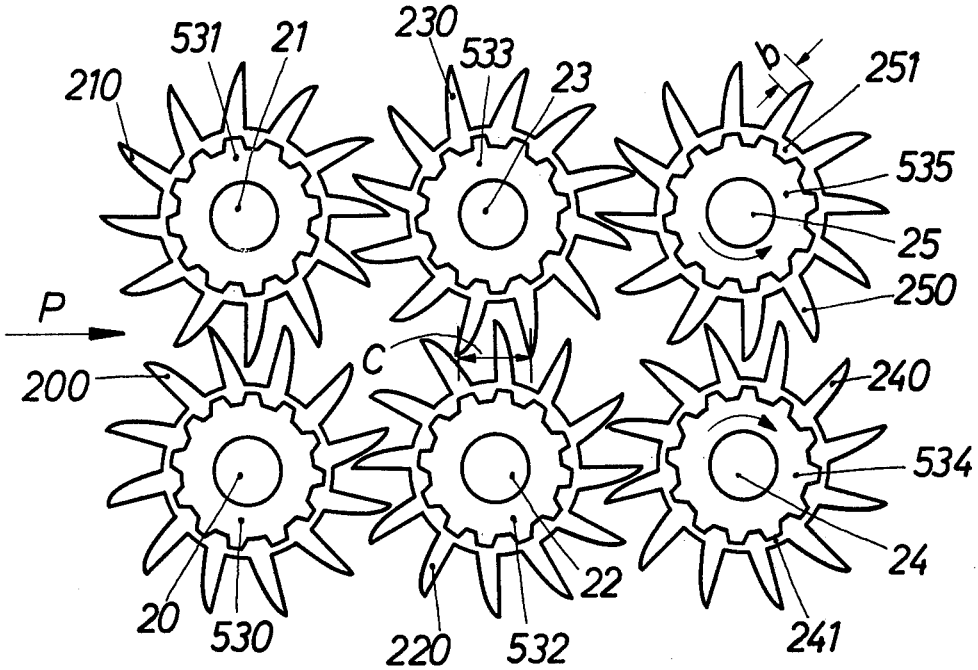
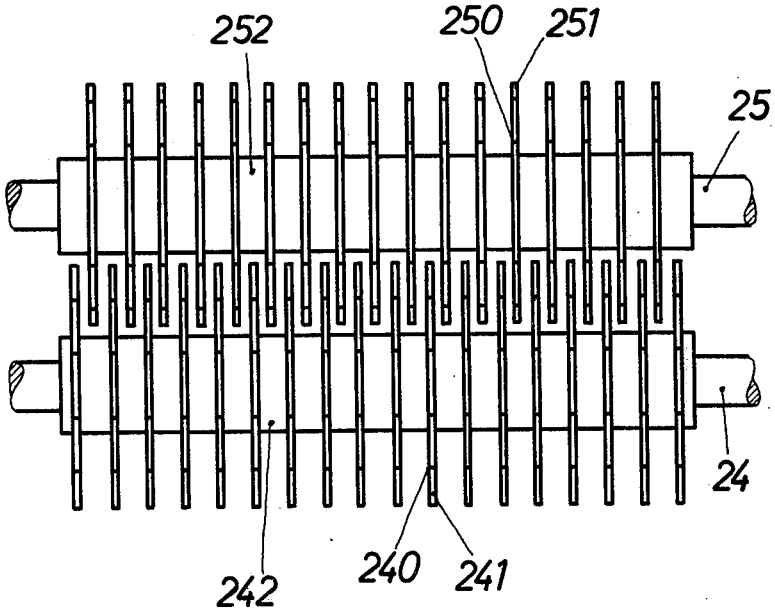
Fig. 3
INVENTORS,
LUDWIG SCHMITT
JOACHIM KIPPING
BY
Robert W. Beach
ATTORNEY INVENTORS,
LUDWIG SCHMITT
JOACHIM KIPPING
BY Robert W. Beach
ATTORNEY

DEVICE FOR DRAFTING LONG STAPLE FIBRE SLIVER

This is a continuation of application Ser. No. 353,713, filed Apr. 23, 1973, now abandoned, which was a continuation of application Ser. No. 139,629, filed May 3, 1971, now abandoned.

The invention relates to methods and apparatus for drafting long staple fibre slivers, and more particularly to apparatus and methods in which rollers with projections such as teeth or needles are arranged in pairs in the drafting zone for guiding the textile fibre material.

In accordance with the prior art the drafting of long staple fibre sliver is carried out with the use of fallers for guiding the fibres so as to form, in accordance with a preferred form of the apparatus, a double faller field with gill points projecting from below and from above into the fibre material in the drafting zone. Since the moving fallers provide a positive but at the same time slack guidance for the fibre material, such drafting devices, termed intersecting gill boxes, provide for a drafting of the material under controlled condititons. The drafted fibre slivers therefore have a corresondingly high degree of evenness. Gill boxes are, however, complicated in construction and noisy in operation. In the case of present day high speeds of machine operation they are also subjected to a high degree of wear and the prospects for increasing their speeds of operation are extremely limited. There has therefore already been a further prior proposal to use pairs of porcupine rollers with intersecting and intermeshing needles instead of the double faller arrangements (see U.S. Pat. No. 2,761,179). Furthermore there has been another proposal to replace the twin arrangements of fallers by pairs of toothed rollers whose teeth partially overlap in a vertical and a horizontal direction (see U.S. Pat. No. 3,611,507). The aim of these arrangements with needles and teeth has been that of achieving a loose guidance of the fibre in the drafting zone as is necessary for perfect drafting. A further proposal, made with the aim of providing a short staple fibre drafting device with porcupine rollers as fibre retaining means, was to arrange needles in offset relationship to each other with spacing between the needles of the upper and lower rollers, which rollers are driven by friction, in order to be able to guide the fibres under controlled conditions through the drafting zone (see German Pat. No. 461,251 and corresponding British specification No. 264,574).

it has, however, been found that with the known devices controlled drafting of the fibre material was not possible. If the porcupine rollers are driven by friction as proposed, frictional slip leads to a change in the speed of the rollers and thus to a change in the relative positions of the needles. The needles or teeth then assume positions in which the fibre material is pressed between them and the drafting operation is opposed for a short time by an increased resistance, which resistance is overcome by an increased drafting force lasting a correspondingly short time. This procedure results in jerky fibre movements in the drafting zone leading to irregularities in the drafted devices also cause irregularities in the sliver, since the backlash in the drive has a disadvantageous effect on the drafting operation.

In the development of the present invention it was discovered that conventional drafting mechanism drive systems are not suitable for toothed or porcupine rollers. With such drives it is not possible to produce any fibre sliver whose Uster values are comparable with those of sliver from gill boxes. One aim of the present invention is to provide a method and apparatus in which long staple fibres can be guided without any impairment of their freedom of movement in the drafting zone, which freedom is necessary for controlled drafting so as to produce a sliver with a high degree of evenness.

The present invention provides in a drafting zone rollers with rows of pointed projections, such rollers being arranged in pairs in the drafting zone for guiding the fibre sliver. The projections of one of a pair of rollers arranged one above the other are interdigitated circumferentially with the projections of the other roller of the pair, such interdigitated teeth being spaced apart to avoid making contact. The rollers are driven positively and without any backlash at constant angular velocity to maintain the projections disposed in this position. The drafting zone preferably contains a plurality of horizontally aligned pairs of upper and lower rollers.

The drive means for the rollers in the drafting zone are endless loops positively engaging toothed wheels on the rollers, each loop preferably driving all corresponding upper or lower rollers. Since this drive is carried out without any backlash the projections, which may be either teeth or needles, of the rollers of each pair always remain synchronized in the most favourable selected relationship for the guidance of the fibres. Imperfections in drafting on starting the device are avoided since all pairs of rollers taking part in drafting are set in rotation at the same time. The constant absence of backlash in the drive can furthermore be guaranteed by providing springloaded jockey rollers for tensioning the toothed belts. Since a theoretically completely backlash-free drive cannot be created, any very minute departures in constant speed of rotation are compensated for by arranging the teeth or needles of the rollers in rows extending helically about the axes of the rollers. In order to avoid the necessity of resetting the rollers with respect to the position of the teeth or needles on reassembly, the number of teeth of the drive wheels is the same and corresponds to the number of teeth or needles arranged on the rollers in the peripheral direction. The backs of the teeth can be rounded at least in the part adjacent to the toothed tips in order to avoid substantially the teeth pulling out fibres as the fibre assembly emerges from the rollers. A switching-off device which can be operated by a jockey roller in response to a change in tension of its toothed belt ensures that the drafting device is not excessively loaded and damaged by any wrapping of fibre around the rollers and similar accumulations of fibre. Further details of the invention will now be described with reference to the accompanying drawings.

FIG. 2 is a side elevation showing pairs of toothed rollers in accordance with FIG. 1 on an enlarged scale.

FIG. 3 is a front elevation of a pair of toothed rollers.

Figure 1:
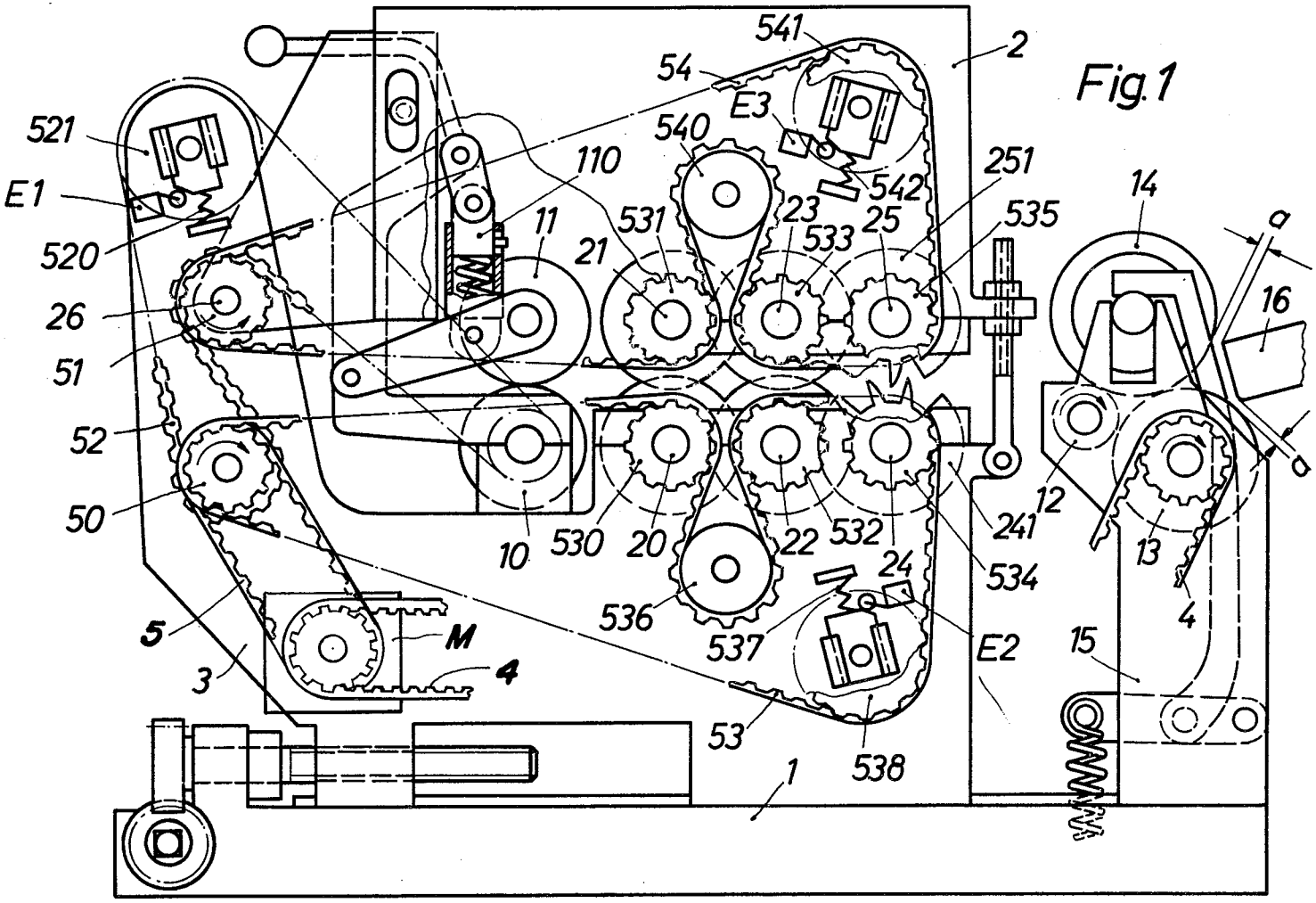
FIG. 1 is a side elevation showing apparatus in accordance with the invention with pairs of toothed rollers for guiding the fibres.
Figure 4:
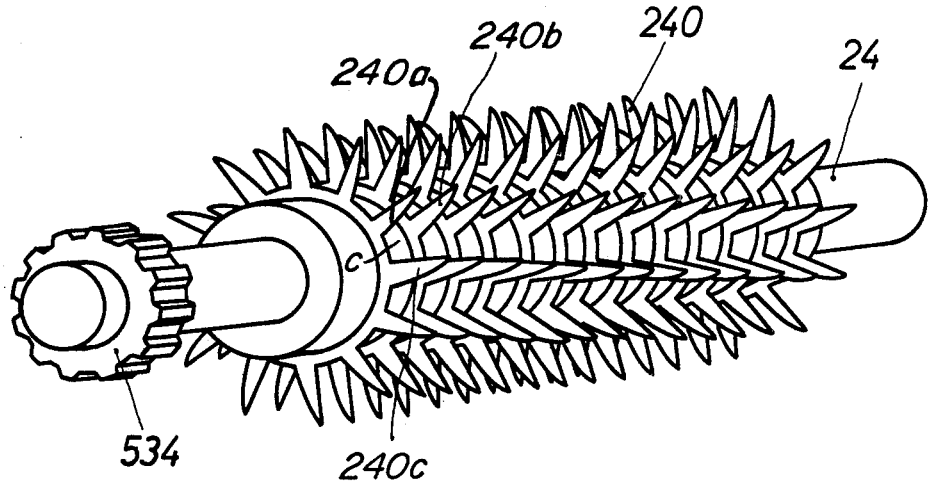

FIG. 4 is a top perspective of a toothed roller with rows of teeth arranged helically about the axis of the roller. Between the supply roller pair 10, 11 (FIG. 1) and the drafting rollers 12, 13, 14, toothed roller pairs 20, 21; 22, 23; and 24, 15 are arranged by means of which the fibres are guided in the drafting zone. The arrangement of three toothed roller pairs has been found convenient for combed yarn or worsted drafting devices. In accordance with the size of the drafting zone and the diameter of the rollers, it is naturally possible also to use less than three such pairs of rollers, or more than three, for guiding the fibre. The toothed rollers 20, 22, 24 whose teeth extend upwards into the fibre material and the lower supply roller 10 are mounted on a slide or carriage 3 which can be slid on the frame 1 of the device. The bearings for the rollers 21, 23, 25 co-operating with the toothed rollers 20, 22, 24 and having teeth projecting downwards into the fibre material are fixed to a frame 2 which can be pivoted about a pin 26 journalled in the slide 3, which slide forms a housing. The bearing for the upper supply roller 11, which is pressed by means of a conventional loading means 110 against the roller 10, is not connected with the frame 2. A stationary bearing support 15 fixed on the machine frame 1 accommodates the drafting rollers 12, 13 14. The drafting rollers therefore always have a constant spacing *a* from a sliver guiding tube 16, through which the drafted fibre sliver is passed to a depositing device, now shown.

The teeth of rollers 20, 21 . . . 25 are formed by a number of toothed discs which are arranged as shown in FIG. 3. On the roller spindles toothed discs 241, 251 are fixed and locked against rotation relative to the spindle. The teeth 240, 250 of these discs are arranged in a conventional manner in rows parallel to the axis of the roller. By means of spacing collars 242 and 252, respecitvely, the toothed discs 241 and 251 are separted from each other on their respective rollers, and the discs 241 are arranged, in accordance with a preferred feature of the invention so as to be axially offset relative to discs 251. Also, the toothed discs of each roller pair are offset from the discs of the corresponding adjacent rollers of other roller pairs. The offset arrangement of the toothed discs makes it possible to reduce the spacing between the toothed rollers so that the teeth can penetrate more deeply into the fibre material and the points at which the teeth of sequentially following pairs of rollers penetrate the fibre material lie close enough together in order to ensure a positive guidance of the fibres. In other words as illustrated in FIG. 3, each of the projections 250 of one row on guiding roll 25 is longitudinally spaced from a substantially correspondingly located projection 240 on the guiding roller 24.

There is naturally also the possibility of vertically aligning the toothed discs of the upper and lower rollers of each roller pair and only offsetting such discs relative to the toothed discs of the adjacent roller pairs of the toothed discs need not be offset. In the latter case, however, owing to the opposite direction of rotation of the rollers adjacent in the horizontal direction, the roller pairs 20, 21; 22, 23; and 24, 25 must have such a spacing from each other that the circles described by the teeth tips do not make contact. However, with such an arrangement the points at which the teeth of adjacent pairs of rollers penetrate the fibre material are correspondingly spaced apart, so that with such a device it is only suitable for drafting fibre material consisting of fibres with a particularly long staple.

Irrespective of the arrangement of the toothed discs described above, their setting with relation to the position of teeth is always such that the teeth 200, 220, 240 of the lower toothed rollers 20, 22, 24 and the teeth 210, 230, 250 of their mating rollers 21, 23, 25 fit into the circumferential spaces *c* between adjacent teeth (FIG. 2). While interdigitated the teeth therefore do not make contact i.e., as seen in axial view, the teeth of one roller are not in registry or alignment with adjacent teeth of the other roller in the fibre sliver penetrating zone, so that it is possible for the fibres to slide between the free spaces left between the teeth and to follow without resistance the movement given it by the toothed roller pairs 20, 21 . . . 25 of the drafting rollers 12, 13, 14 in the direction of the arrow P. This interdigitated relationship of the teeth, which is particularly favourable for the guidance of the fibres, does not change any part of the course of the drafting operation, since the drafting apparatus is driven by toothed belts which transmit the driving force without any backlash. Such toothed belts mesh with drive wheels 530, 531 . . . 535 fixed on the ends of the toothed rollers 20, 21 . . . 25. The angular velocity of the rotating teeth therefore remains constant. In other words as illustrated in FIG. 2 the outer ends of the projections, for example, teeth 250 of one row of projections carried on guiding roller 25 projects radially inwardly and between the outer ends of the projection 240 of two adjacent rows of projections carried on the other guiding roller 24 when the projections of the guiding rollers 24 and 25 are in fibre penetrating position.

In order to prevent any periodic takeup and release of fibre material over the whole width, the discs on each of the toothed rollers 20, 21 . . . 25 are rotated relative to each other so that the disc teeth form helical lines or rows extending about the axis of the respective roller. By circumferentially spacing the adjacent projections of each row of projections carried on a roller a helical configuration is created. As illustrated in FIG. 4, the circumferential spacing between the adjacent teeth in one row (i.e., 240*a* and 240*b*) is substantially less than the pitch C between corresponding teeth 240*a* and 240*c* of adjacent rows. This arrangement of the teeth, which is shown in FIG. 4 with reference to the toothed roller 24 carrying teeth 240, ensures that the rows of teeth progressively penetrate the fibre assembly in the drafting zone across the width of the assembly and are withdrawn from it in the same progressive manner. The fibre assembly thus always is penetrated by some of the teeth so that linear movement of the fibre material through the drafting zone is always positively controlled. The release of the fibres by the teeth is facilitated by the backs of the teeth in the zone *b* adjacent to the toothed tips being slightly rounded (FIG. 2). The fibres can slide off the tooth backs as soon as the respective tooth leaves the fibre assembly. Any wrapping of the fibres about the rollers, which might otherwise occur due to the teeth taking fibres with them as the teeth are withdrawn from the fibre assembly is thereby avoided.

The drive of the drafting apparatus is carried out in a manner usual in the case of drawing frames by a motor M (FIG. 1) arranged in the machine frame. Its drive force is transmitted without backlash by a toothed belt 4 to the drafting roller 13 and by a second toothed belt 5 to the drive wheel 50. A toothed belt 52, with teeth on opposite belt sides, also in engagement with the drive wheel 50, drives the drive wheel 51 and the supply roller 10. The necessary tension of the toothed belt 52 is ensured by a spring-loaded jockey roller 521 which is pressed by a spring 520 against the belt. The lower toothed rollers 20, 22, 24 are driven without backlash from drive wheel 50 by a toothed belt 53, which engages drive wheels 530, 532, 534 fixed on the spindles of such rollers, respectively, and passes over an idler roller 536. The drive belt 53 is tensioned by a jockey roller 538 loaded by the pressure of a spring 537.

In the same manner the upper toothed rollers 21, 23, 25 are driven without backlash from the drive wheel 51 by a toothed belt 54. The belt 54 engages the toothed drive wheels 531, 533, 535 and passes around an idler roller 540 and a jockey roller 541 with a loading compression spring 542. All drive wheels 530, 531 . . . 535 have the same number of teeth (FIG. 2) so that the toothed belts 53, 54 drive all toothed rollers 20, 21 . . . 25 with the same angular velocity.

Preferably also the drive wheels 50, 51 have the same number of teeth as the drive wheels 530, 531 . . . 535. In accordance with FIG. 2, however, the number of teeth of the drive wheels 530, 531 . . . 535 corresponds to the number of teeth 200, 210 . . . 250 arranged on the toothed rollers 20, 21 . . . 25 in the circumferential direction. Owing to the same tooth pitch being used it is possible to ensure that the toothed belts can be engaged with the teeth of the drive wheels on reassembly only when the teeth of the toothed disc pairs are relatively positioned with cooperating teeth on each disc projecting into the circumferentially spaced gaps between teeth on the other disc and such cooperating teeth are not in alignment. Time-consuming setting operations are therefore avoided.

The resilient arrangement, described above, of the toothed belt jockey rollers 521, 538, 541 is also used for ensuring that the drafting device is not overloaded and damaged, something which might otherwise occur owing to blockage of the rollers when material becomes wrapped around the rollers causing retardation of the speed of roller rotation. As soon as the belts are subjected to increased forces, the jockey roller 521, 538 or 541 is displaced and actuates the corresponding limit switch E 1, E 2 or E 3 which causes the motor M to be switched off.

The apparatus in accordance with the invention has been described with reference to pairs of toothed rollers as fibre guide means. It is, however, obvious that instead of toothed rollers it would also be possible to use porcupine rollers. Furthermore, for the drive of the drafting device without backlash it would be possible to use drive means other than belts, such as chains, for example.

What we claim is:

1. In apparatus for drafting long staple fibre slivers including a first pair of drafting rollers, a second pair of drafting rollers spaced from said first pair of drafting rollers, a pair of guiding rollers located between said first and second pairs of drafting rollers for positively guiding fibre slivers along a substantially linear path between the drafting roller pairs, the improvement comprising:

each of said guiding rollers having pointed substantially radial projections arranged in generally longitudinal rows, the outer ends of said projections of one row of projections carried on one of said guiding rollers projecting radially inwardly and between the outer ends of said projections of two adjacent rows of projections carried on said other guiding roller when the projections of said guiding rollers are in fiber sliver penetrating position, said adjacent projections of each row of projections carried on said rollers being circumferentially spaced substantially less than the pitch between corresponding teeth of adjacent rows producing a helical configuration of teeth, each of said projections on said one guiding roller being longitudinally spaced from a substantially corresponding located projection on said other guiding roller, a drive sprocket carried by each roller, and endless loop drive means positively engageable with the roller drive sprockets for driving said rollers at constant angular velocity without backlash and thereby maintaining such offset relationship of the adjacent sliver-penetrating projections of said two rollers.

2. In the apparatus defined in claim 1, the number of projections circumferentially of each roller is constant along the length of the roller, and the roller drive wheel has the same number of teeth as the circumferential number of roller projections.

3. Apparatus for drafting long staple fiber slivers comprising a first pair of drafting rollers, a second pair of drafting rollers spaced from said first pair of drafting rollers, a pair of guiding rollers located between said first and second pairs of drafting rollers for positively guiding fiber slivers between the drafting roller pairs, each of said guiding rollers having pointed substantially radial projections arranged in generally longitudinal rows, the longitudinal radial plane of row of projections of one guide roller projecting between longitudinal radial planes of the two adjacent rows of projections of the other guiding roller when the projections of the row of said one guide roller are in fibre sliver penetrating position and the longitudinal rows of projections of each guiding roller being circumferentially offset from the longitudinal rows of projections of the other guiding roller sufficiently to prevent any portion of a projection of one roller being in axial alignment with adjacent projections of the other roller when said projections are in fiber sliver penetrating position, a drive sprocket carried by each guiding roller, and endless loop tooth belts positively engageable with the roller drive sprockets for driving said rollers at constant angular velocity without backlash and thereby maintaining such offset relationship of the adjacent sliver-penetrating projections of said two of said rollers, drive means for driving the toothed belts, spring loaded jockey roller means engageable with each toothed belt for tensioning such belt, and limit switch means actuatable by movement of the jockey roller means for interrupting operating of the toothed belt drive means, the roller rotation being retardible by excessive fibre between the rollers, the tension of the toothed belts being increasible in response to roller retardation and the jockey roller means being movable in response to increased belt tension to actuate said limit switch means.

* * * * *